United States Patent [19]

Krueger

[11] 4,097,002

[45] Jun. 27, 1978

[54] PAPER TOWEL HOLDER

[76] Inventor: John H. Krueger, 29600 Hillcrest Dr., Chisago City, Minn. 55013

[21] Appl. No.: 763,349

[22] Filed: Jan. 28, 1977

[51] Int. Cl.[2] ..... B65H 19/00

[52] U.S. Cl. ..... 242/55.2; 248/201

[58] Field of Search ..... 242/55.2–55.53, 242/73; 248/201, 216, DIG. 5

[56] References Cited

U.S. PATENT DOCUMENTS

| | | | |
|---|---|---|---|
| 2,371,109 | 3/1945 | Sanford | 242/55.2 |
| 2,460,903 | 2/1949 | Peck | 248/201 X |
| 3,088,686 | 5/1963 | Curry | 242/55.2 |
| 3,319,855 | 5/1967 | Tucker et al. | 242/55.2 X |
| 3,593,361 | 7/1971 | Welt | 242/55.2 X |
| 3,653,733 | 4/1972 | Wyant | 242/73 X |

*Primary Examiner*—Harvey C. Hornsby

*Assistant Examiner*—John M. Jillions

*Attorney, Agent, or Firm*—Robert D. Farkas

[57] ABSTRACT

An adjustable means suited to hold and dispense paper toweling is provided which includes telescoping wall mounting means, strap means hingedly connected to opposite end of the wall mounting means which cantilever outwardly to a normal relative to a plane through the wall mounting means, and plug means mounted on the strap means which are receivable, respectively, in opposite ends of a core for machine wound paper toweling. Another aspect of the invention is to provide a roll of paper toweling having at least one continuous longitudinal score line therein, whereby a discrete section of the roll may be separated therefrom. The holding and dispensing means is adjustable to the width of the separated section of the roll.

4 Claims, 3 Drawing Figures

PAPER TOWEL HOLDER

BACKGROUND OF THE INVENTION

The present invention relates to holding means for dispensing paper toweling and, more particularly, the instant invention relates to a wall mounted towel holder and dispenser which is adjustable to a plurality of towel widths.

Commercially available paper toweling is most usually machine rolled around a hollow paperboard core. The toweling is discretely scored widthwise for separating individual sheets thereof from the roll. It is another aspect of this invention to score the toweling and core correspondingly lengthwise so that discrete corresponding sections of toweling and core may be separated from the roll. The holder and dispenser of the instant invention is adjustable to the width of toweling and core separated from the roll.

SUMMARY OF THE INVENTION

Generally speaking, in accordance with the invention, an adjustable means suited to hold and dispense paper toweling is provided which includes telescoping wall mounting means, strap means hingedly connected to opposite ends of the wall mounting means which cantilever outwardly to a normal relative to a plane through the wall mounting means, and plug means mounted on the strap means which are receivable, respectively, in opposite ends of a core for machine wound paper toweling.

A concomitant aspect of the invention is to provide a roll of paper toweling having at least one continuous longitudinal score line therein, whereby a discrete section of the roll may be separated from the main body of the roll. The holding and dispensing means is adjustable to the width of the separated section of the roll.

Accordingly, it is an object of the invention to provide novel means for holding and dispensing paper toweling.

Still another object of the invention is to provide a roll of paper toweling that may be broken down to a variety of widths depending upon the desired usage thereof.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DETAILED DESCRIPTION OF THE INVENTION

Figure 1:
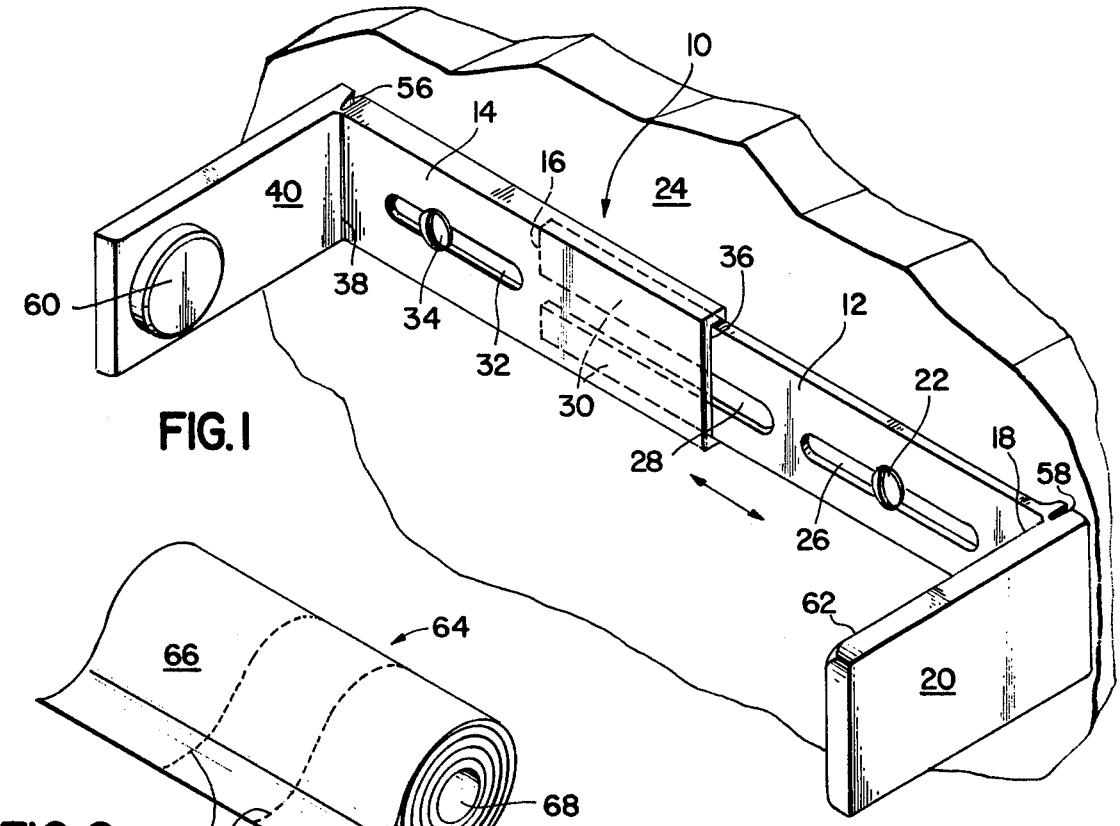
FIG. 1 is a perspective view of a holder for toweling constructed in accordance with the invention.
Figure 3:
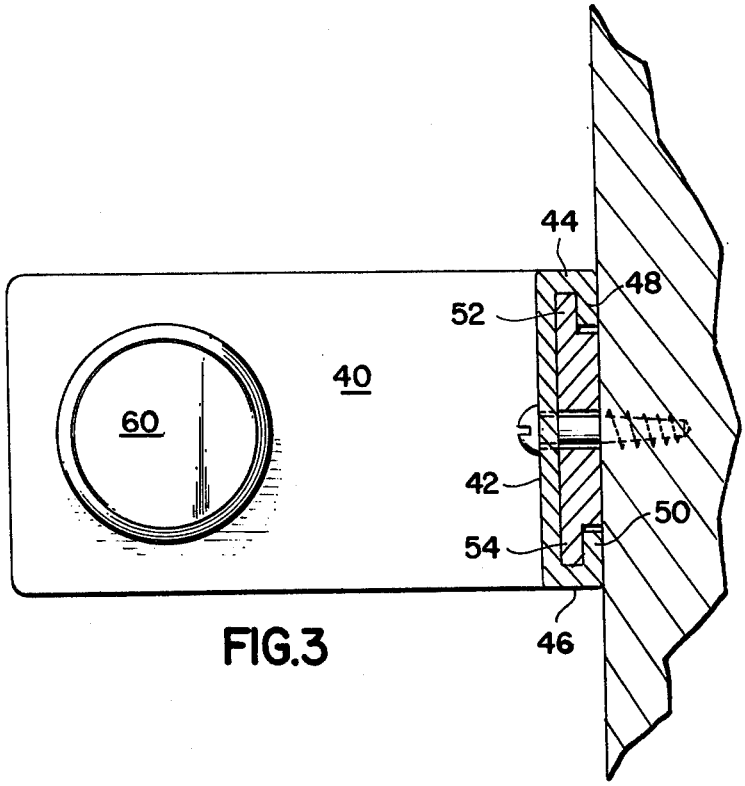
FIG. 3 is a sectional view of the embodiment seen in FIG. 1.

Referring now particularly to FIGS. 1 and 3, a holding and dispensing means generally numbered 10, within the scope of the invention, is wall mounted on a pair of telescoping brackets 12 and 14. Bracket 12 has a free end 16 and an opposite end 18 hingedly connected to a strap 20. A stud, screw or the like 22 is employed to slidably mount bracket 12 on a wall 24. A longitudinally elongated slot 26 is provided in bracket 12 and stud 22 is introduced through slot 26 into wall 24, until the head thereof frictionally engages the outer surface of bracket 12, as seen in FIG. 1. As thus mounted, bracket 12 is axially longitudinally slidable on wall 24 within the limits determined by slot 26.

The free end 16 of bracket 12 is bifurcated, an interiorly extending longitudinal slot 28 therein defining a pair of runners 30 which telescope into bracket 14, as hereinafter described in detail. Bracket 14 is slidably mounted on wall 24 in the same manner as bracket 12 by means of a corresponding cooperable slot and stud arrangement 32, 34. Runners 30 are received in bracket 14 through a free end 36 thereof, while a second opposite end 38 thereof is hingedly connected to a strap 40 which is substantially a mirror image of strap 20. Bracket 14 comprises a substantially planar web 42, a pair of sidewalls 44 and 44 normally depending from opposite sides thereof and each sidewall having connected thereto a respective inwardly turned lip flange 48 and 50, as best seen in section in FIG. 3.

Runners 30 of bracket 12 fit complementarily within the channel defined in bracket 14. A pair of rail flanges 52 and 54 are provided in runners 30 which overfit the lip flanges 48 and 50 in bracket 14 to key the respective positions of the brackets as bracket 12 telescopes into bracket 14. Slot 28 between runners 30 is sufficiently wide to provide a clearance around stud 34 as bracket 12 telescopes into bracket 14.

As best seen in FIG. 1, brackets 12 and 14 are bidirectionally axially slidable. The extent to which brackets 12 and 14 may be telescoped or retracted is respectively determined by the corresponding slot and stud arrangement in each bracket.

Straps 20 and 40 close inwardly against brackets 12 and 14, respectively. Each strap may be cantilevered outwardly until it is substantially normal to its hingedly connected bracket. Each of the straps 20 and 40 is provided with a corresponding butt flange 56 and 58 which abuts against its respective bracket to stop and determine the outward position of the strap. In their outermost position, as seen in FIG. 1, straps 20 and 40 are substantially parallel.

Figure 2:
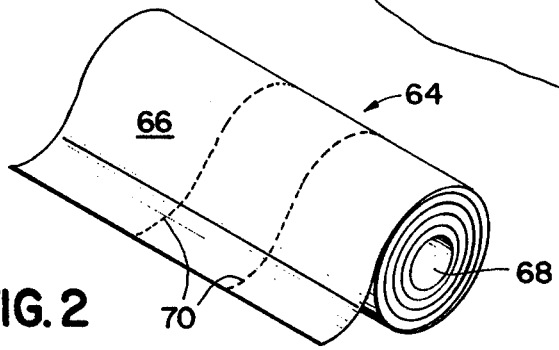
FIG. 2 is a perspective view of a roll of toweling constructed in accordance with another aspect of the invention.

Corresponding male plugs 60 and 62 are respectively mounted on the interior surfaces of straps 20 and 40 to provide means for rotatably mounting a roll of paper toweling 64 in the holder 10. As best seen in FIG. 2, a roll of paper 66 is wound around a hollow tubular core 68 and plugs 60 and 62 are receivable in respective opposite ends thereof. The core 68 journals on plugs 60 and 62 as paper 66 is pulled from the roll.

Score lines 70 are provided in paper 66 and corresponding score lines, now shown, are provided in core 68, whereby a discrete section may be separated from the roll 64 for use. In this way, paper may be conserved since only so much as is necessary may be used. Straps 20 and 40 may be adjusted to the length of roll 64 by suitably telescoping or retracting brackets 12 and 14.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A device suited to hold and dispense paper toweling from a roll thereof comprising, a first bracket, a second bracket, said first bracket being telescopable into said second bracket between first and second predetermined limits, a strap means, said first and second brackets each having a free end respectively proximate each other and an end hingedly connected to said strap means, said first bracket comprising a first substantially planar web having an interior longitudinally elongated first slot located therein, means for slidably mounting said first bracket on a wall, said means for slidably mounting said first bracket being introduced through said first slot into a wall and having a first camming surface along which said first slot may cam between first and second positions, said second bracket comprising a channel member including a second substantially planar web, a pair of sidewalls, each sidewall depending normally from an opposite edge of said second web, each of said sidewalls terminating in a respectively inwardly turned lip flange, said second web of said second bracket having an interior longitudinally elongated second slot therein, means for slidably mounting said second bracket on said wall, said means for mounting said second bracket being introduced through said second slot into said wall and having a second camming surface along which said second slot may cam between another set of first and second positions, said free end of said first bracket having an interiorly extending longitudinal slot therein defining first and second runners in closely spaced relationship to each other, said first and second runners being telescopable into said second-bracket, said interiorly extending longitudinal slot having sufficient clearance so as to permit said first and second runners to by-pass said means for mounting said second bracket to said wall, means to hingably limit said strap means to a cantilevered position extending outwardly and normally from a plane passing through said first bracket and said second bracket, and journal means mounted on said strap means on which said roll of paper toweling may rotatably journal as said paper toweling is dispensed.

2. The device as claimed in claim 1, said first and second runners including a rail flange, respectively correspondingly complementary to said lip flanges in said second bracket, so as to provide a tight slidable fit between said first and second brackets as they are telescoped.

3. In combination with the device as claimed in claim 2, a roll of paper toweling having at least one continuous longitudinal score line therein for the length of said roll, so as to permit a discrete section of said roll to be held in said device, said device being adjustable to the width of said discrete section of said roll.

4. The device as claimed in claim 2, said strap means comprising a pair of straps, one of said straps being hingedly connected to said first bracket and the other of said straps being hingedly connected to said second bracket.

* * * * *